US006388952B2

(12) United States Patent
Kim

(10) Patent No.: US 6,388,952 B2
(45) Date of Patent: May 14, 2002

(54) PROGRAMMABLE TIME SWITCH

(76) Inventor: Joo-Sul Kim, 601-701, Tanhyun-maul, 1479 Tanhyun-dong, 411-320, Ilsan-ku, Koyang-Si (KR)

( * ) Notice: Subject to any disclaimer, the term of this patent is extended or adjusted under 35 U.S.C. 154(b) by 0 days.

(21) Appl. No.: 09/860,090

(22) Filed: May 17, 2001

Related U.S. Application Data

(63) Continuation of application No. PCT/KR98/00367, filed on Nov. 17, 1998.

(51) Int. Cl.[7] ..... G04B 23/02; G04C 21/00; G04C 17/02; G08B 1/00

(52) U.S. Cl. ..... 368/74; 368/82; 368/108; 368/240; 340/309.4

(58) Field of Search ..... 368/10, 72–74, 368/82–84, 107–109, 239–242, 250–251; 340/309.15, 309.4

(56) References Cited

U.S. PATENT DOCUMENTS 4,407,587 A * 10/1983 Fujita ..... 368/108

FOREIGN PATENT DOCUMENTS

EP 141655 * 5/1985
EP 730209 * 9/1996

* cited by examiner

*Primary Examiner*—Vit Miska
(74) *Attorney, Agent, or Firm*—Schweitzer Cornman Gross & Bondell LLP

(57) ABSTRACT

A programmable time switch where a time or time interval set by a user to be reserved is displayed on a display. The display has a current time display part for displaying an hour hand and a minute hand which represent a current time, an hour unit display part for displaying the reserved time or time interval in terms of hours, and a minute unit display part for displaying the reserved time or time interval in terms of minutes. The current time and the AM or PM are digitally displayed on a current time display section and an AM/PM display section, respectively. A set section having a plurality of buttons are used for setting, canceling or confirming the reserved time or time interval. A control section controls through a drive section a peripheral interface in accordance with the reserved time or time interval set through the set section, and displays the reserved time or time interval through the display. A memory provides a program and a work area which are necessary for controlling operation of the control section. A clock supply section supplies a clock which is necessary for the controlling operation of the control section.

15 Claims, 16 Drawing Sheets

CURRENT TIME AM10:30
RESERVED TIME AM11:30

CURRENT TIME AM10:40
RESERVED TIME AM11:30

CURRENT TIME PM01:00
RESERVED TIME1 AM11:30 ~PM01:37
RESERVED TIME2 PM01:50 ~PM02:30
RESERVED TIME3 PM11:00 ~AM01:00

CURRENT TIME AM09:30
RESERVED TIME PM02:30

PROGRAMMABLE TIME SWITCH

This application is a Continuation of PCT/KR98/00367 filed Nov. 17, 1998.

TECHNICAL FIELD

The present invention relates to a programmable time switch, and more particularly, the present invention relates to a programmable time switch which supplements a function of a timer for controlling operations of diverse electronic and electric instruments or equipment and by which a user can easily make reservations for times or time intervals, cancel such reservations, confirm reservations, and input the current time.

BACKGROUND ART

Generally, a timer has several operating modes as shown in FIG. 1. The operating modes of the timer include an A mode in which the timer is started at a current time and converted from an on-state to an off-state when a reserved time is reached or a reserved length of time is lapsed, a B mode in which the timer is started at the current time and converted from the off-state to the on-state when the reserved time is reached or the reserved length of time is lapsed, a C mode in which the timer is started from the off-state, is converted to the on-state for the reserved length of the time as the current time reaches the reserved time, and then is returned to the off-state, and a D mode in which the timer is started from the on-state, is converted to the off-state for the reserved length of time as the current time reaches the reserved time, and then is returned to the on-state.

In the timer having the operating modes described above, a number of time reservations can be easily set and simply confirmed.

Among timers of the prior art, a minute minder (timer) of a spiral spring type provides advantages in that it allows a desired time interval to be easily set from a current time. However, the minute minder of a spiral spring type has low precision in turning on/off equipment or an instrument at a precise time. Also, a mechanical programmable time switch of a quartz-vibrated type or a motor type provides advantages in that since a reserve pin is disposed in a shape of a circle and has 24 hour representations, a reserved time can be confirmed at a glance. However, since the mechanical programmable time switch is mechanically turned on or off, precision is deteriorated relying upon play between elements thereof. Also, since the reserve pin must be inserted by hand, it is difficult to reserve a minute unit which is smaller than 10 minutes or 15 minutes. Further, the mechanical programmable time switch has disadvantages in that the reserve pin must be disposed in the counterclockwise direction.

In addition, while an electronic timer of a figure arranging type has high precision to allow time reservations of a second unit, it takes too much time to set a reservation program, an input scheme is so complicated that it is apt to be forgotten whereby the reservations must be set while referring to a manual. Also, the reservations cannot be confirmed at a glance.

Further, another electronic timer of a circular crystal type provides advantages in that when a minimum segment is set to be larger than 20 minutes. However, in the electronic timer, it takes too much time to set the reservation at one minute or 5 minute units. For example, if one minute can be reserved into one segment and it takes on second, 10 seconds are need to reserve 10 minutes, 60 seconds are needed to reserve one hour, and 720 seconds (12 minutes) are needed to reserve 12 hours. For this reason, it takes too much time to set the reservations. Also, in the electronic timer, since a reserve mode or a release mode must be selected when one segment is passed upon reservation, a visual discrimination is made difficult.

DISCLOSURE OF THE INVENTION

Accordingly, the present invention has been made in an effort to solve the problems occurring in the prior art, and an object of the present invention is to provide a programmable time switch by which a number of time reservations are easily set and simply confirmed, whereby convenience of a user is enhanced.

In order to achieve the above object, according to the present invention, there is provided a programmable time switch comprising: a display for displaying a time or a time interval set by a user to be reserved, the display having a current time display part formed at a center portion thereof for displaying an hour hand and a minute hand which represent a current time, an hour unit display part formed at a middle portion thereof for displaying the reserved time or time interval in terms of hours, and a minute unit display part formed at an edge portion thereof for displaying the reserved time or time interval in terms of minutes; a current time display section, an AM/PM display section and a mode display section for digitally displaying the current time, the AM or PM and an operating mode of a timer, respectively; a set section having a plurality of buttons for setting, canceling or confirming the reserve time or time interval; a control section for controlling through a drive section a peripheral interface connected thereto in accordance with the reserved time or time interval set through the set section, and for displaying the reserved time or time interval through the display; a memory for providing a program and a work area which are necessary for controlling operation of the control section; a clock supply section for supplying a clock which is necessary for the controlling operation of the control section; and a switch for keeping the drive section turned on or off irrespective of a setting of the timer or for making the drive section operate the timer.

BRIEF DESCRIPTION OF THE DRAWINGS

The above objects, and other features and advantages of the present invention will become more apparent after a reading of the following detailed description when taken in conjunction with the drawings, in which.

BEST MODES FOR CARRYING OUT THE INVENTION

Figure 1:
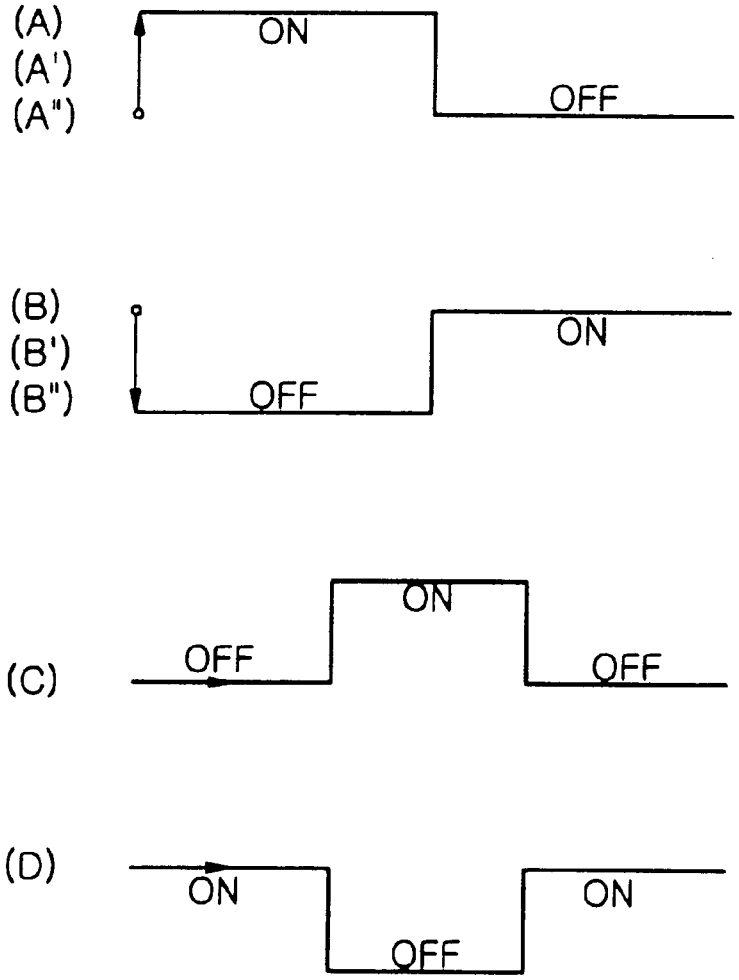
FIG. 1 is a graph illustrating operating modes of a timer.

Reference will now be made in greater detail to a preferred embodiment of the invention, an example of which is illustrated in the accompanying drawings. Wherever possible, the same reference numerals will be used throughout the drawings and the description to refer to the same or like parts.

Referring the programmable time switch of the present invention as a timer hereinafter is merely for the convenience of illustrating an embodiment and of explaining the present invention and is not for limiting the scope of the present invention.

Figure 2:
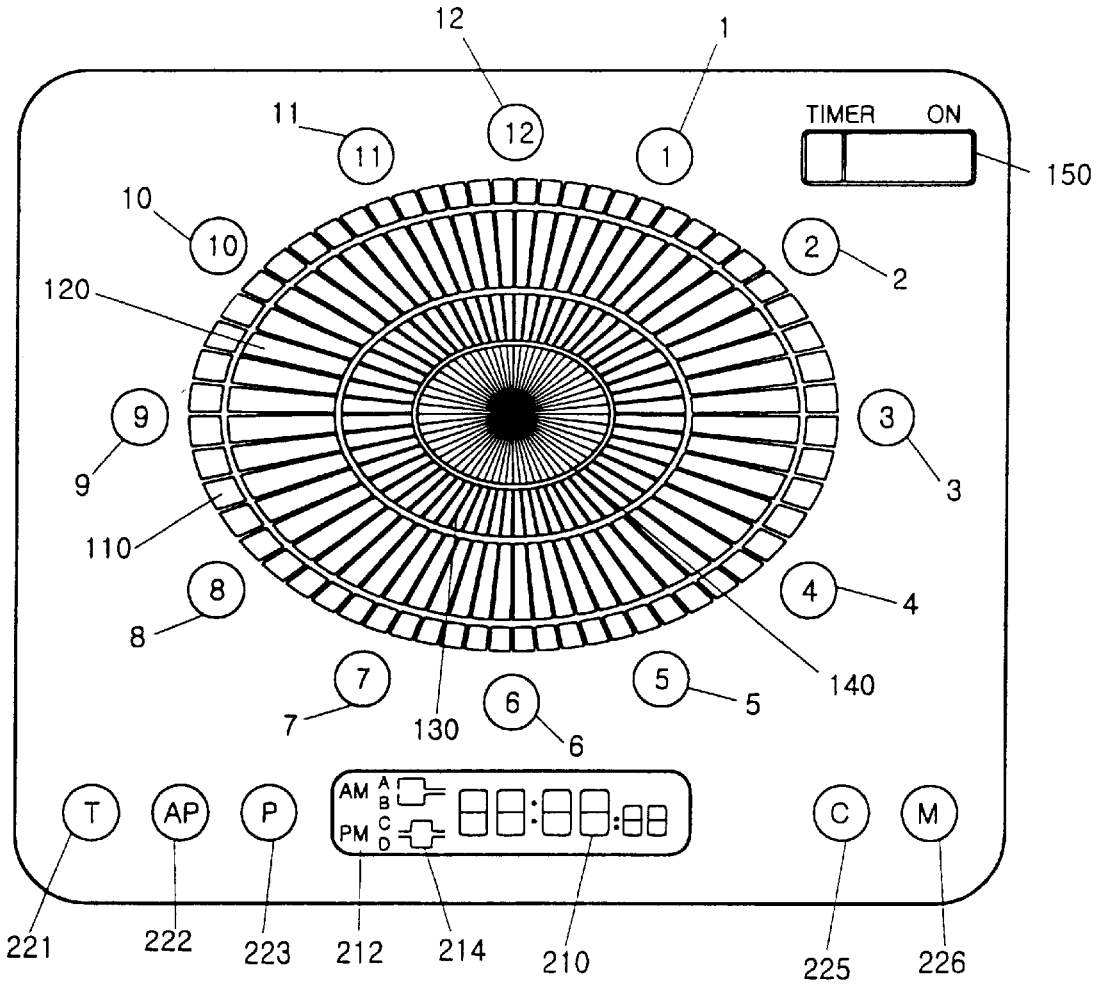
FIG. 2 is a front view illustrating a construction of a programmable time switch in accordance with an embodiment of the present invention.
Figure 11:
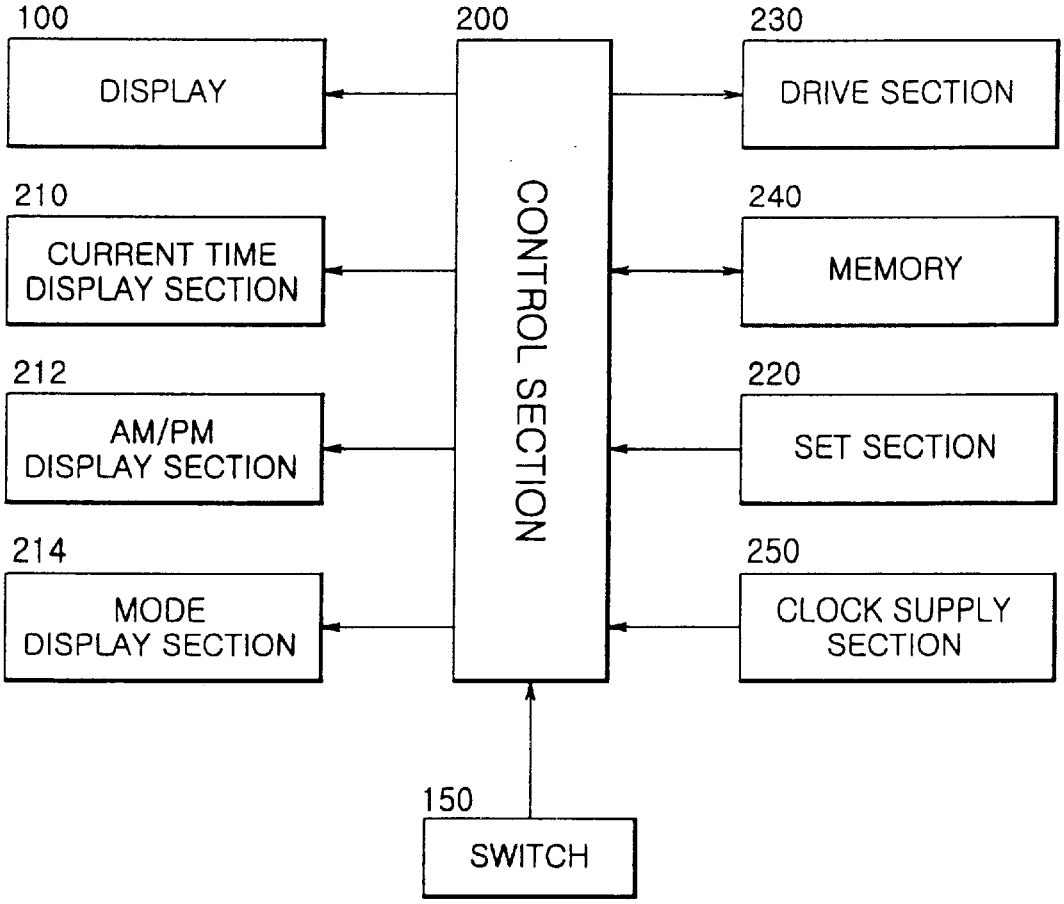

Referring to FIG. 2 and 11, a programmable time switch according to the present invention includes a display 100 having an hour hand 140 and a minute hand 130 formed at a center portion thereof to represent a current time, an hour unit display part 120 formed at a middle portion thereof and having segments of the number of a multiple of 6 or 12 for displaying a reserved time or time interval in terms of hours, and a minute unite display part 110 formed at an edge portion thereof and having segments of the number of a multiple of 60 for displaying the reserved time or time interval in terms of minutes; a current time display section 210, an AM/PM display section 212 and a mode display section 214 for digitally displaying the current time, the AM or PM and an operating mode of a timer, respectively; a set section 220 having a plurality of buttons 1–12, T, AP, P, C and M for setting, canceling or confirming the reserved time or time interval and conditions thereof; a control section 200 for controlling through a drive section 230 a peripheral interface connected thereto in accordance with the reserved time or time interval and conditions thereof set through the set section 1–12, T, AP, P, C and M, and for displaying the reserved time or time interval and conditions thereof through the display 100; a memory 240 for providing a program and a work area which are necessary for a controlling operation of the control section 200; a clock supply section 250 for supplying a clock which is necessary for the controlling operation of the control section 200; and a switch 150 for keeping the drive section 230 turned on or off irrespective of a setting of the timer or for making the drive section 230 operate the timer.

The display 100 has, as shown in FIG. 2, the hour hand 140 and the minute hand 1130 and 140 including the hour hand 140, which are formed at the center portion thereof to represent the current time (Here, if it is necessary to display a second hand, a segment having the same size as the minute hand 130 and 140 can be used). The display 100 also has the hour unit display part 120 formed at the middle portion thereof and having segments of the number of the multiple of 12 for displaying the reserved time or time interval in terms of hours, and the minute unit display part 110 formed at the edge portion thereof and having segments of the number of the multiple of 60 for displaying the reserved time or time interval in terms of minutes. The display 100 can be manufactured using a luminous element such as a liquid crystal display (LCD) panel or an electro-luminescence (EL) cell.

The current time display section 210 digitally displays the current time. In addition, the AM/PM display section 212 for displaying the AM or PM and the mode display section 214 for displaying one of operating modes A, A', A", B, B', B", C and D of the timer, are provided together with the current time display section 210. The mode display section 214 displays one of the operating modes A, A', A", B, B', B", C and D of the timer, which is selected through a mode select button M by a user.

The set section 220 includes twelve time set buttons 1 through 12 disposed around the display 100 for symbolizing one through twelve o'clock and for allowing the reserved time or time interval to be set through it; a current time set button T used when setting the current time; a timer set button P used when setting the reserved time or time interval as the timer; a cancel button C for canceling the reserved time or time interval; an AM/PM select button AP for selecting AM or PM and for confirming reservations of the timer; and a mode select button M for selecting one of the operating modes of the timer.

Here, when displaying the reserved time or time interval on the display 100, since all reservations including reserved times or time intervals which are within 12 hours from the current time must be displayed in the hour unit display part 120 having a configuration such as a circle, etc., it is difficult to precisely display minute units of the reservations on the hour unit display part 120. In other words, if the minute unit of the reserved time or time interval includes not 0 minutes or 30 minutes but 5 minutes, 47 minutes, etc., the reserved time or time interval cannot be precisely displayed to the minute unit when displayed on the hour unit display part 120. This problem is resolved by the minute unit display part 110. Namely, if the reserved time is 1:37, for displaying 37 minutes, the minute unit display part 110 is colored from a position of a 12th button 12 to a position of a clockwise 37th segment denoting 37 minutes. In this way, the minute unit of the reserved time or time interval can be precisely displayed.

For providing a display, in case of the hour unit display part 120, an hour (for example, a time interval between a 12th button 12 and a 1st button 1) is composed of a certain number of segments, for example 6 or 12 segments. Accordingly, the hour unit display part 120 as a whole is composed of 72 or 144 segments. Further, in case of the minute unit display part 110, a time interval between the 12th button 12 and a 1st button 1 is composed of 5 segments. Accordingly, the minute unit display part 110 as a whole is composed of 60 segments.

As methods of input for the said set section, various methods such as buttons or the touch screen may be used.

Hereinafter, operations of the programmable time switch constructed as mentioned above, will be described in detail. The operations of the programmable time switch of the present invention will be explained while being set out into embodiments for setting the timer. Four timer modes as shown in FIG. 1 will be exemplified.

First, because the current time must be precisely set, the current time set button T is pressed. All characters except for the AM/PM display part will disappear from the digital display part and either AM or PM will blink. If the current time is 9:30 AM, a user will select AM by pressing the AM/PM select button. When the AM/PM select button is pressed, then-blinking AM will change into PM (PM into AM) and will stop blinking. Until the time is confirmed as a final data, the AM/PM select button may be pressed to change the AM/PM mode at any time while the current time is being set. In order to display the hour 9, the 9th button 9 is pressed, and in order to display the minute 30, the 6th button 6 which is at the location indicating the minute 30 is pressed. Then, the current time has been set and, the current time will be displayed through the current time display section 210, the hour hand 130 and the minute hand 130 and 140. During the time setting period, the part displaying the hour or the minute, once a number for which is selected, does not blink but awaits the next input. When the current time set button T is pressed again at, last, the time set as described above is recognized and confirmed as the current time data. Also, if there is no other input within a predetermined period of time (for example, 4 seconds) after the previous input for the current time, the time set as described above becomes recognized and determined as a final data.

12 o'clock AM is digitally displayed as 00:00. This, of course, may be displayed as AM 12:00.

At this time, if it is necessary to display a separate second hand, the minute hand 130 and 140 can be used as it is. Since the second hand moves every second, even when a time change of a second unit is displayed using the minute hand, the second hand and the minute hand can be clearly distinguished from each other.

Here, coloring conditions of the display 100 are defined as follows. A monochromatic LCD generally has a white ground color and is colored with black when an electric field is applied to a liquid crystal. Accordingly, in the embodiments of the present invention, the timer is white-colored at its off-state and is black-colored at its on-state (Of course, it is possible to conversely define the coloring conditions. The same shall apply hereinafter.)

While an A mode and a B mode of the timer will be first described hereinbelow, since both the A mode and B mode have three embodiments, the three embodiments will be explained one by one based on the A mode (B mode is operated contrary to the A mode).

1. A First Embodiments of A Mode (A Mode)

Figure 3A:
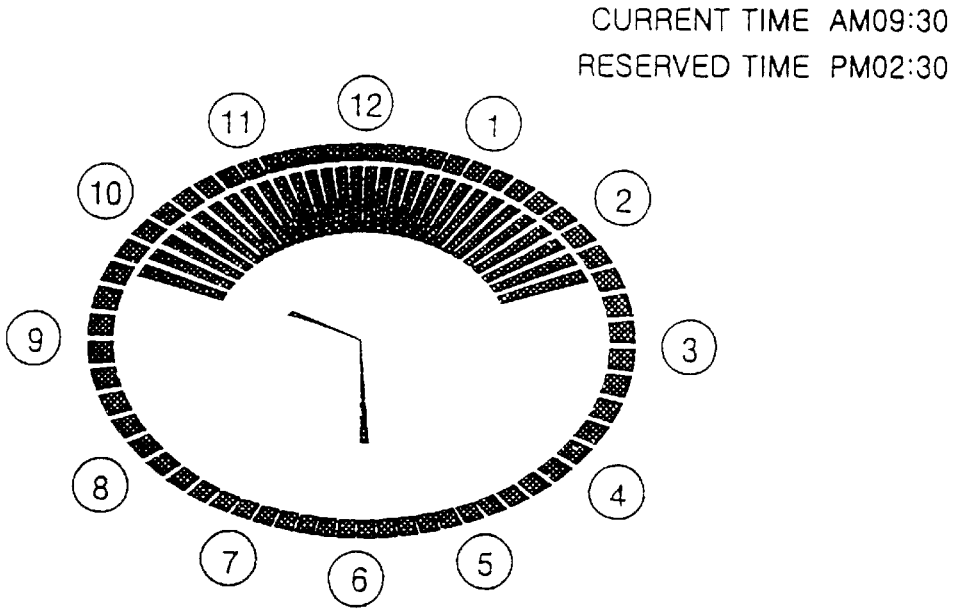
FIGS. 3 through 9 are front views illustrating various display situations of a display embodying the present invention.
Figure 3B:
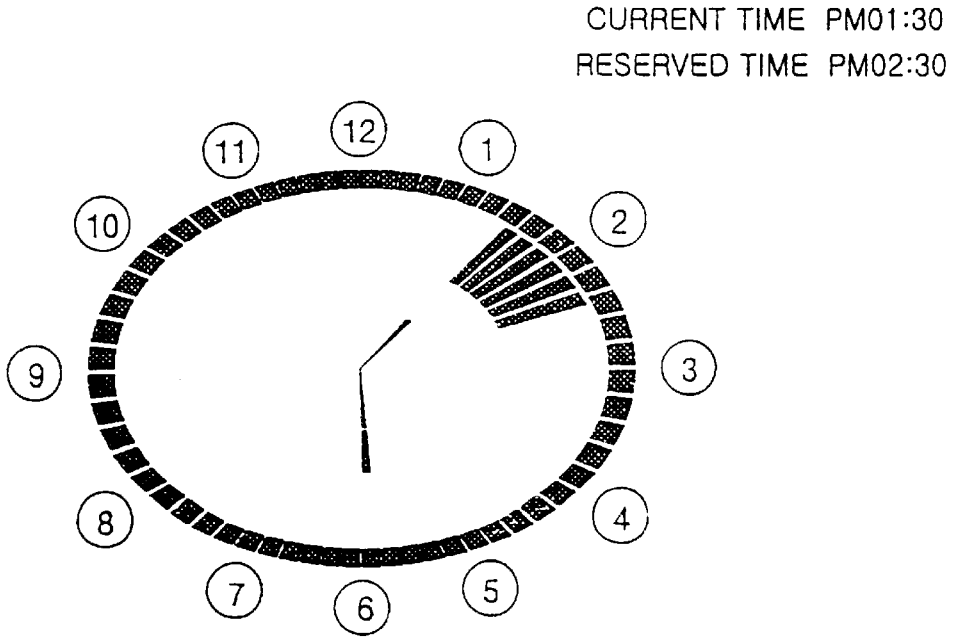
Figure 3C:
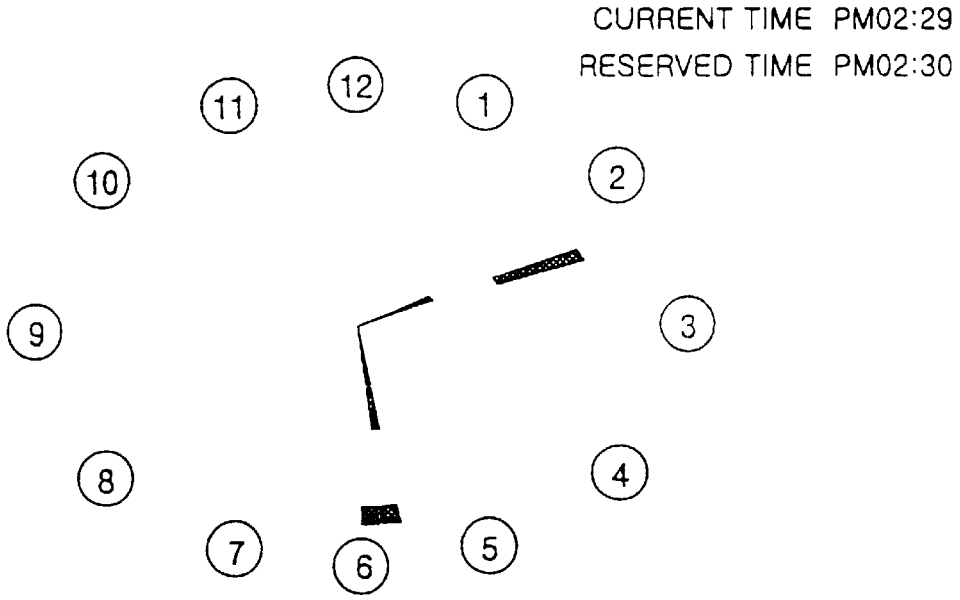

The A mode is, as shown in FIG. 3, started at the current time and converted from the on-state to the off-state when the reserved time is reached or a reserved length of time is lapsed. Hereinbelow, operations of the timer in the A mode will be explained.

The A mode is first selected through the mode select button M. If the current time is 9:30 AM and the reserved time is 2:30 PM, after the timer set button P is pressed, the AM/PM select button AP is pressed to select the PM. Then, a 2nd button 2 is pressed and the 6th button 6 denoting a position of 30 minutes is pressed one time.

At this time, if the 6th button 6 is not pressed any more in a predetermined time (for example, 3 seconds), 30 minutes are set in the timer, and if the 6th button 6 is pressed on more time in the predetermined time (3 seconds), the next minutes (time) are set in the timer. For example, when setting 2:31, after the 6th button 6 is pressed, the 6th button 6 is pressed one more time in the predetermined time (3 seconds). Also, when setting 2:32, after the 6th button 6 is pressed, the 6th button 6 is pressed two more times. In this way, a time can be increased by one minute to 2:34 relying upon the number of times the 6th button is pressed (The same shall apply hereinafter).

If the input for AM or PM was incorrect, even if it is in the middle of setting a time, a user may change AM to PM and vice versa by pressing the AM/PM select button.

In reserving a time, if the minute is not specified, the programmable time switch will recognize it as the minute 00 and will go to the next step. For example, in a case where the current time is 9:30 AM and the time to be reserved is 10:00 AM, if a user presses the timer set button P, pressed the 10th button 10, and then does not press any button for a predetermined period of time or presses the timer set button again, the recognized reserved time will be 10:00 AM (same in the following).

When the timer set button P is pressed, the AM/PM display part will blink but once input for the reserved time begins, such blinking will stop and the next input will be awaited, which is same when the current time is set. Also, at any time during the input of a time, pressing the AM/PM select button AP will change the AM or PM display at the AM/PM display part, which shows whether the reserved time is AM or PM (same in the following).

The result displayed on the display 100 is as follows.

In order to display 2:30 in terms of hours, the hour unit display part 120 is colored from a middle position (denoting 30 minutes) between the 2nd button 2 and a 3rd button 3 to a position of the current time (since the current time is continuously changed, this position of the current time is also changed in accordance with the current time) (see FIG. 3(A))

All segments of the minute unit display part 110 are colored. Since the setting of the reserved time is completed, the AM/PM display section 212 having the PM flashed is restored to its original state to represent the AM according to the current time.

If the current time is between 9:30 AM and 1:30 PM, since the reserved time does not exist within 60 minutes form the current time, all segments of the minute unit display part 110 are maintained in the colored state. If the current time passes 1:30, namely at the moment when the current time passes 1 hour, 30 minutes and 1 second, a 31st segment from the position of the 12th button 12 is uncolored (The same shall apply hereinafter).

In other words, from this time, A 30th segment denoting 60 minutes later from the current time (since the reserved time is set to 2:30) is maintained colored. As the time continuously goes by, segments are converted to an uncolored state one by one every one minute, (FIG. 3 represents a case in which the current time 2:29), and finally as the current time passes 2:30 PM, all segments of the hour unit display part 120 and the minute unit display part 110 are converted to the uncolored state.

2. A Second Embodiment of A Mode (A' Mode)

This embodiment is used for providing a 60 minute timer, and due to this, a maximum timer set time is limited to 60 minutes. In this embodiment, the timer can be set by the minute unit within 60 minutes irrespective of the hour unit.

For example, if the current time is 9:30 AM and the reserved length of time is 30 minutes, the timer operates as follows.

After selecting the A' mode through the mode select button M, in order to set the reserved length of time to 30 minutes, the 6th button 6 denoting 30 minutes is pressed on time. (If the reserved length of time is 47 minutes, the 9th button 9 denoting 45 minutes is pressed three timed in the predetermined time. The same shall apply hereinafter).

Figure 4A:
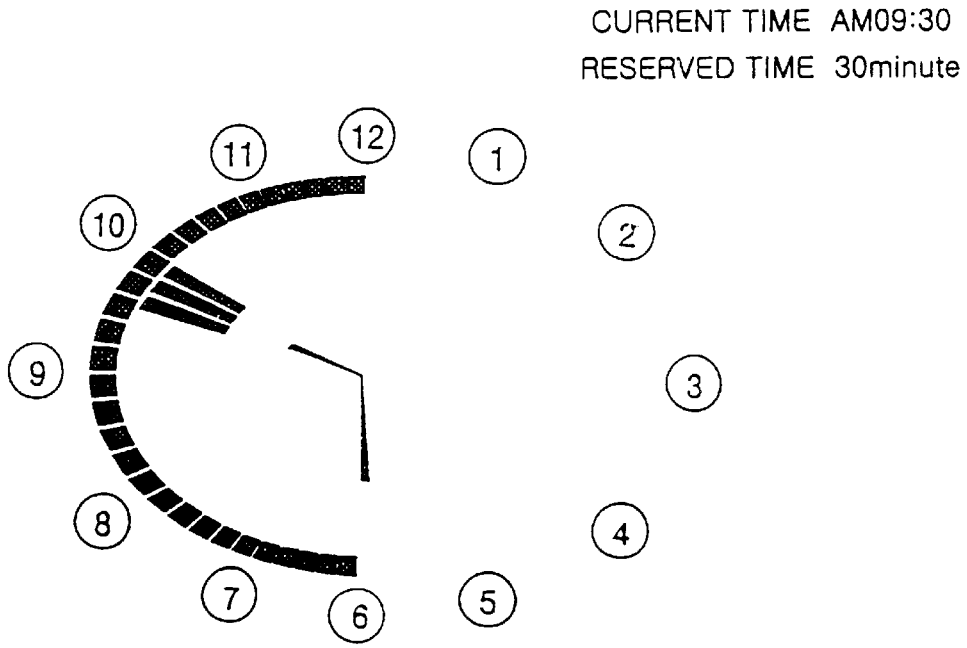
Figure 4B:
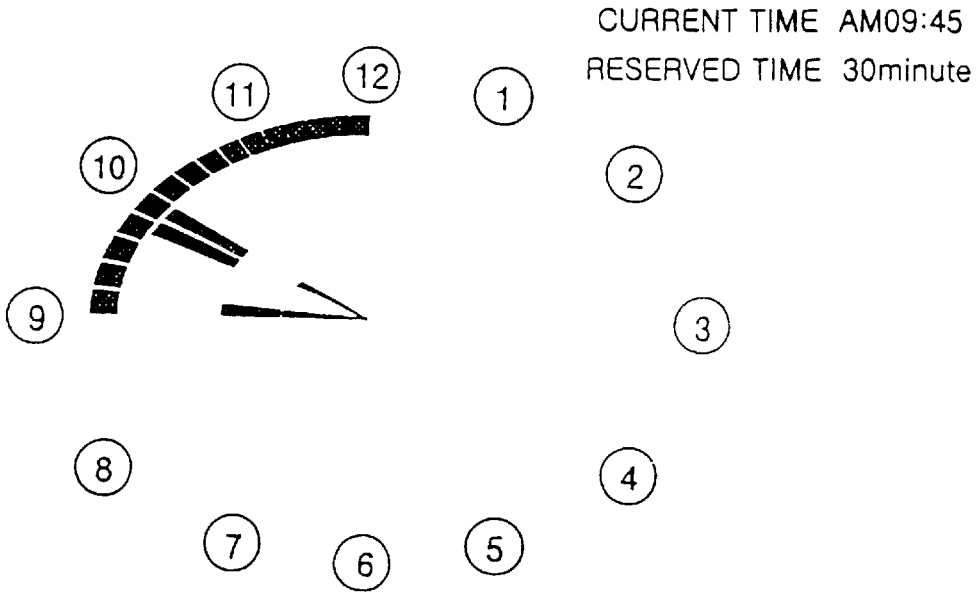
Figure 4C:
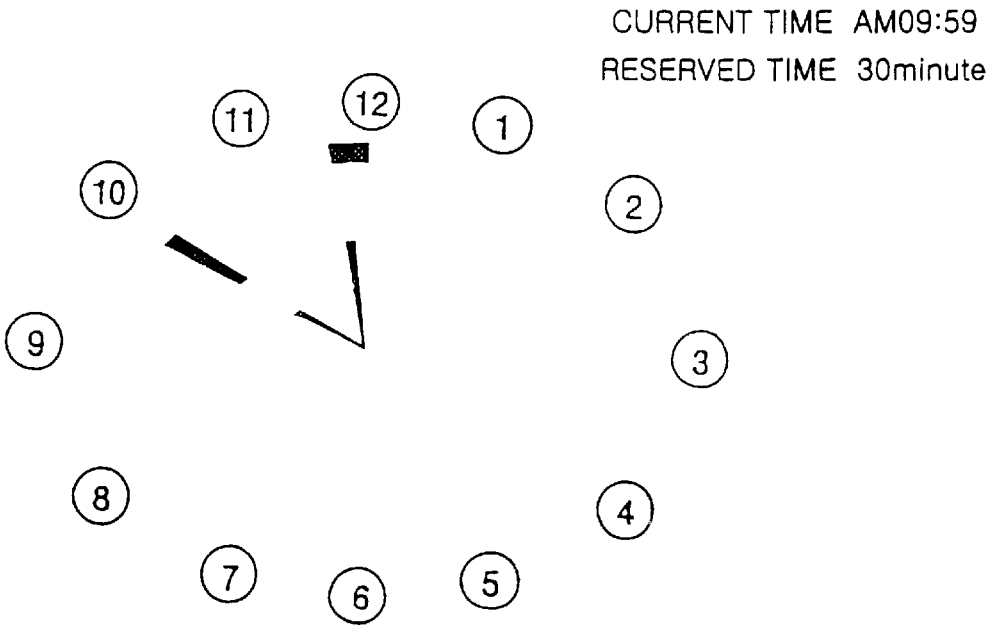

By setting the timer as described above, the hour unit display part 120 and the minute unit display part 110 are maintained in the on-state for 30 minutes from 9:30 to 10:00 to be colored, and as the current time reaches 10:00, they are converted into the off-state. Accordingly, the minute unit display part 110 is, as shown in FIG. 4(A), colored from a position of 30 minutes to a position of 60 minutes at an initial stage. However, as shown in FIG. 4(B) and 4(C), as the current time passes 9:59 to reach 10:00, all segments of the minute unit display part 110 are converted to the uncolored state.

3. A Third Embodiment of A Mode (A" Mode)

This embodiment is used for providing a timer capable of being set over 60 minutes. In this embodiment, a minute unit can be inputted by using the 1st button 1 through a 10th button 10, and by pressing the 10th button 10, '0' is inputted. In other words, by pressing the 1st button 1 through the 9th button 9, numbers of 1 through 9 are inputted, respectively, and by pressing the 10th button 10, a number of '0' is inputted.

Due to this, all numbers of 0 through 9 can be inputted when setting the minute unit. For example, if the current time is 9:30 AM and the reserved length of time is 105 minutes, after the A" mode is selected through the mode select button M and the timer set button P is pressed, the 1st button a, 10th button 10 and a 5th button 5 are sequentially pressed to input the minute unit of 105 minutes.

Figure 5A:
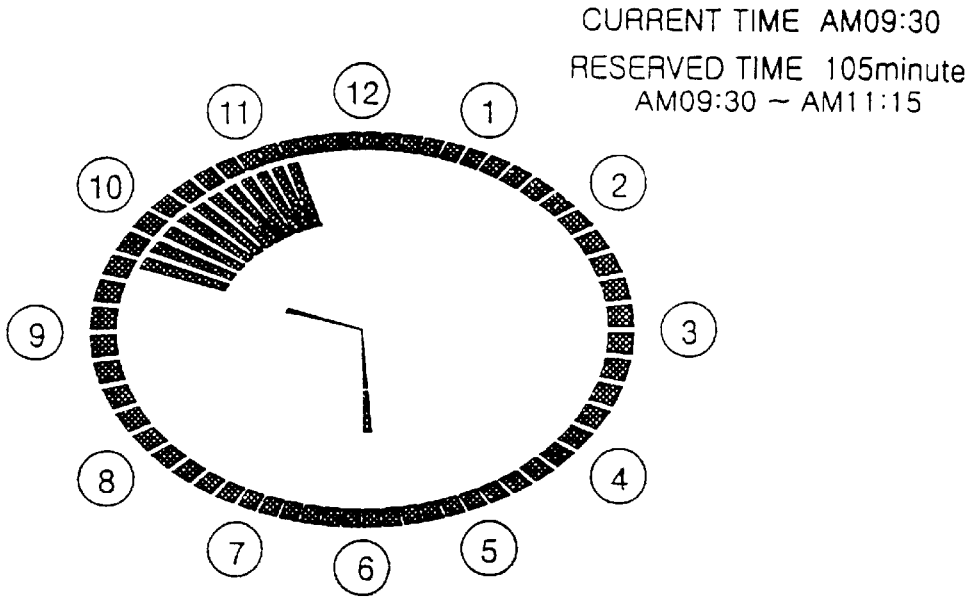
Figure 5B:
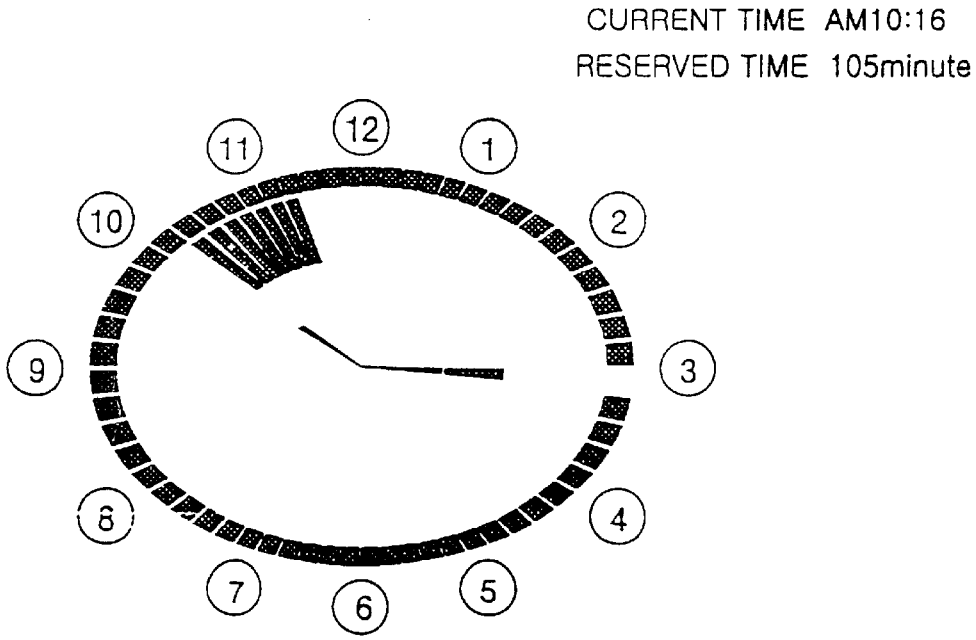
Figure 5C:
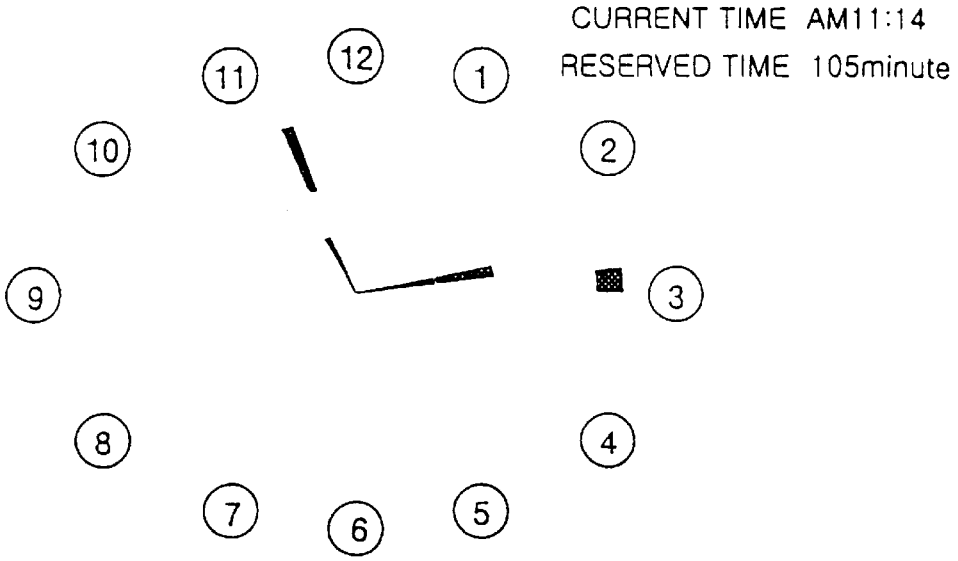

The result displayed on the display 100 is as shown in FIG. 5. Since 105 minutes correspond to one hour and 45 minutes, the hour unit display part 120 is colored from the position of 9:30 to a position of 11:15 which represent a time when 105 minutes corresponding to one hour and 45 minutes are passed from the 9:30. Also, in the minute unit display part 110, since the reservations within 60 minutes from the current time are displayed on the minute unit display part 110, all segment of the minute unit display part 110 are colored (see FIG. 5(A). The same shall apply hereinafter).

Further, when 60 minutes are left to reach the 105 minutes, namely, when the current time reaches 10:16 which is 60 minutes before 11:15, the minute unit display part 110 begins to be uncolored one segment by one segment (see FIG. 5(B)) as the current time goes by one minute (see FIG.

4. B Mode (B, B', B")

The B mode (B, B', B") is the same with the A mode in an operating principle but the coloring conditions thereof are opposite to the A mode.

5. C Mode

The C mode as shown in FIG. 1 is a timer mode in which it is started form the off-state, is converted to the on-state for the reserved length of the time as the current time reaches the reserved time, and then is returned to the off-state. In case of the C mode, as shown in FIG. 6, it is selected through the mode select button M.

If the current time is 10:30 AM and the reserved time interval is from 11:30 AM to 1:37 PM, since the current time belongs to AM, after pressing the timer set button P, an 11th button 11 is pressed to input the hour unit of 11 and the 6th button 6 denoting 30 minutes is pressed one time to input the minute unit of 30. Then, after pressing the timer set button P one more time, the PM is selected through the AM/PM select button AP. Thereafter, in order to input 1:37, the 1st button 1 is pressed to set the hour unit of 1 and a 7th button 7 denoting 35 minutes is pressed three times in the predetermined time to set the minute unit of 37.

In the foregoing, if only the hour is inputted and the minute omitted, then the programmable time switch will recognize it as the minute 00 and will go to the next step. For example, if the reserved time interval is from 10:00 AM to 11:00 AM, a user may press the timer set button P, press the 10th button 10, press the timer set button P, press the 11th button, and then press the timer set button P for the last time to finish reserving a time period.

If the reserved time interval is from 10:00 AM to 2:00 PM, a user would press the timer set button P, the 10th button 10, and then the timer set button P again. After this, the user would select PM by pressing the AM/PM select button AP, and press the 2nd button 2. After confirming that the latter time finally reserved is displayed in the current time display part 210 for a predetermined period of time (for example, 4 seconds), the user may press the timer set button P for the last time or wait without pressing the timer set button for longer than the predetermined period of time (for example, 5 seconds) to complete the input step.

Once the timer setting is completed as described above, the hour unit display part and the minute unit display part for the reserved time will display the reservation from the newly inputted data and go back to the normal mode. The current time display part 210 will also return to its normal mode.

The result displayed on the display 100 in this case is as follows.

Figure 6A:
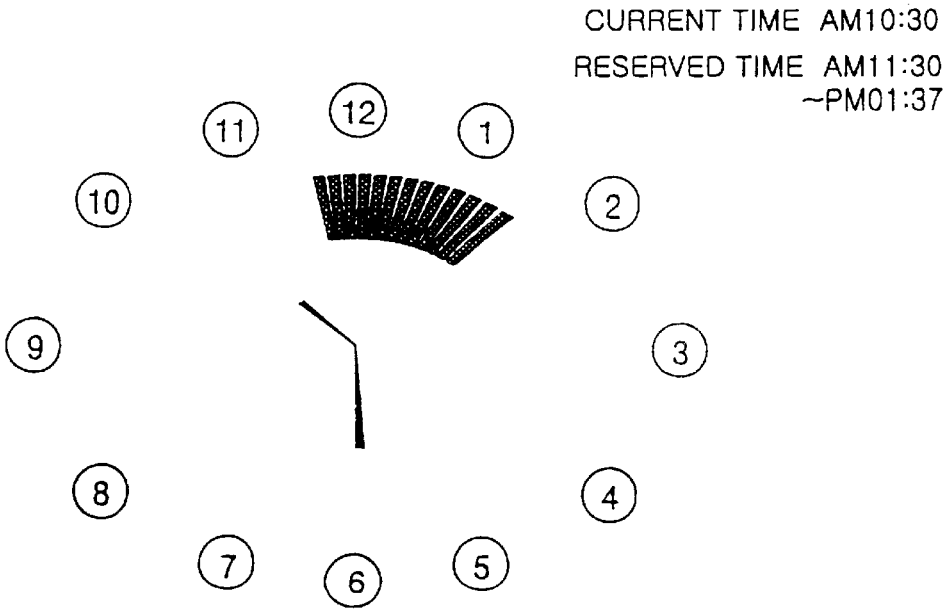

At an initial stage, as shown in FIG. 6(A), the hour unit display part 120 is colored with black from a position of 11:30 (a middle portion between the 11th button 11 and the 12th button 12) to a position of 1:37 (a middle portion between the 1st button 1 and the 2nd button 2), and the remaining portion of the hour unit display part 120 is uncolored. At this time, as the current time passes 11:30, the colored segments of the colored portion on the hour unit display part 120 are converted into the uncolored state one by one in accordance with the current time (see FIG. 6(*c*) ).

Figure 6B:
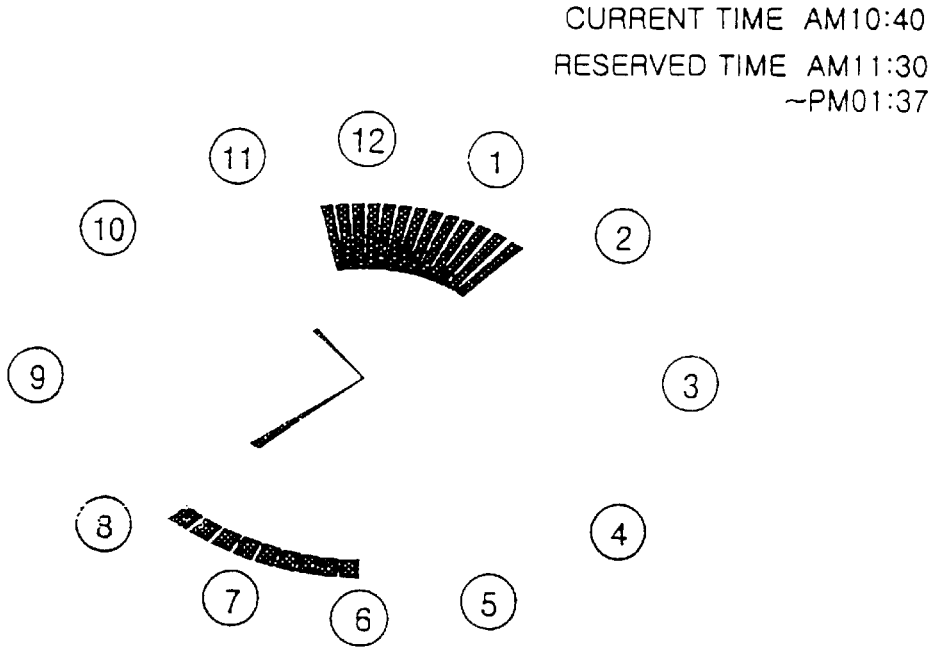
Figure 6C:
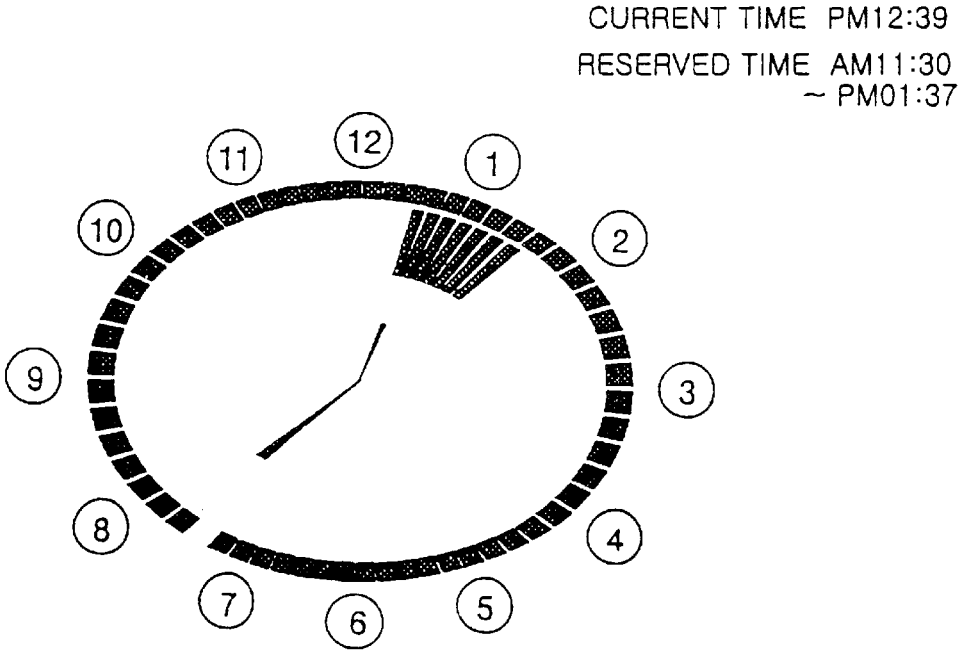

On the other hand, as the current time reaches 10:31 which is 60 minutes before the beginning time of 11:30, the minute unit display part 110 is colored every one minute one segment by one segment from a position of 30 minutes (denoted by the segment of the 6th button 6) (see FIG. 6(B)), and as the current time reaches 12:38 which is 60 minutes before the ending time of 1:37, the minute unit display part 110 is uncolored every one minute one segment by one segment from a position of 38 minutes (denoted by the clockwise third segment from the 7th button 7) (see FIG. 6(*c*)).

6. The Second Example of Embodiment for Mode C.

Instead of setting a reserved time interval such as the interval from 10:30 AM to 1:37 PM when the current time is 10:30 AM as described above, the timer can have a pre-installed program within itself, maintain the on-state from 11:30 AM for a specified time period (for example:instant, 1 second, 1 minute, etc.) and then return to the off-state without setting a time when the timer is to go to the off-state.

Figure 7A:
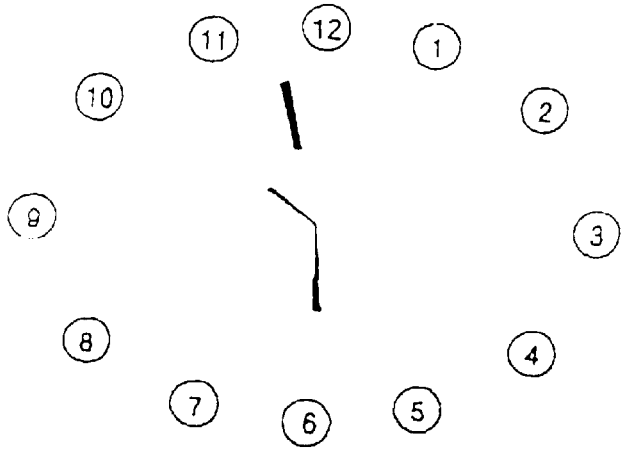

In this case, the corresponding segments of the hour unit display part 120 (the middle segments of the portion between the 11th button 11 and the 12th button 12) are colored with black and the remaining segments are uncolored (see FIG. 7*a*). At this time, as the current time passes 11:30 AM or if a predetermined period of time (for example, 1 second or 1 minute) passes, the colored segments of the hour unit display part 120 disappear.

Figure 7B:
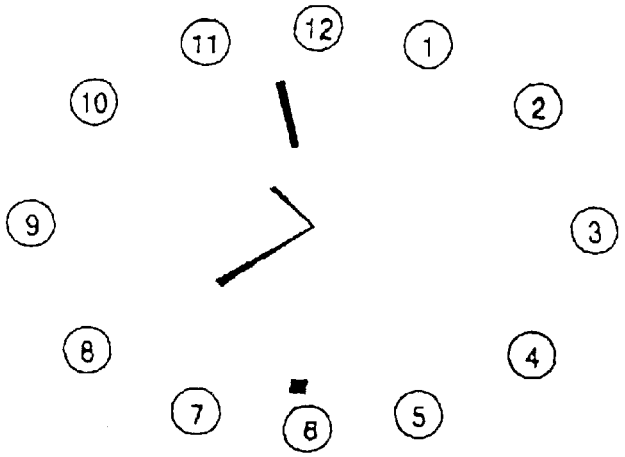
Figure 7C:
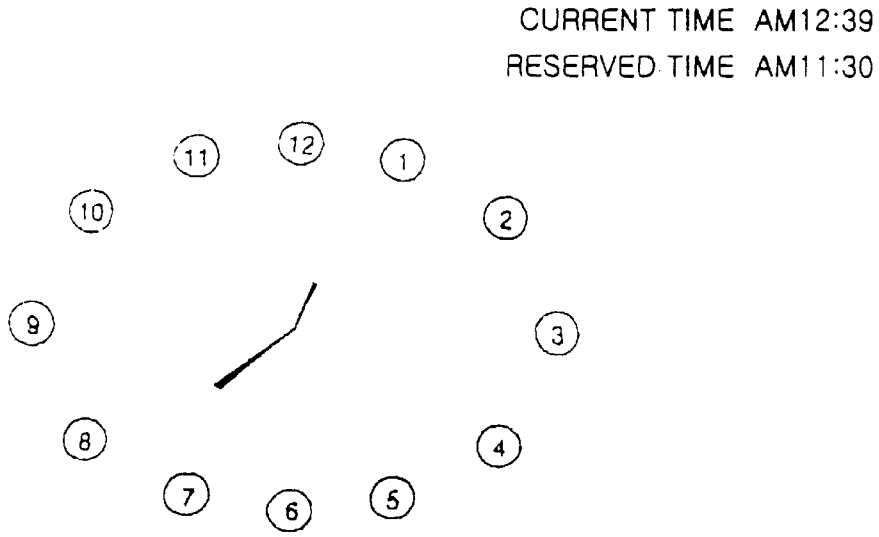

On the other hand, when it becomes 10:30 AM which is 60 minutes before the starting time 11:30 AM, the minute unit display part 110 becomes colored from the position of the minute 30 (the segment for the 6th button) and the segments corresponding to the reserved time period become colored in accordance with the current time. The remaining portion of the minute unit display part remains uncolored (see FIG. 7*b*).

When the current time passes 11:30 AM, the colored segments of the minute display part also disappear in accordance with the current time.

7. D Mode

The D mode as shown in FIG. 1(D) is a timer mode in which it is started from the on-state, is converted to the off-state for the reserved length of time as the current time reaches the reserved time, and then is returned to the on-state. In case of the D mode, as shown in FIG. 8, the D mode is selected through the mode select button M.

If the current time is 10:30 AM and the reserved time interval is from 11:30 AM to 1:37 PM, since the current time belongs to AM, after pressing the timer set button P, the 11th button 11 is pressed to input the hour unit of 11 and the 6th button 6 denoting 30 minutes is pressed one time to input the minute unit of 30. Then, after pressing the timer set button P one more time, the PM is selected through the AM/PM select button AP. Thereafter, in order to input 1:37, the 1st button 1 is pressed to set the hour unit of 1 and the 7th button 7 denoting 35 minutes is pressed three times in the predetermined time to set the minute unit of 37.

The result displayed on the display 100 in this case is as follows.

Figure 8A:
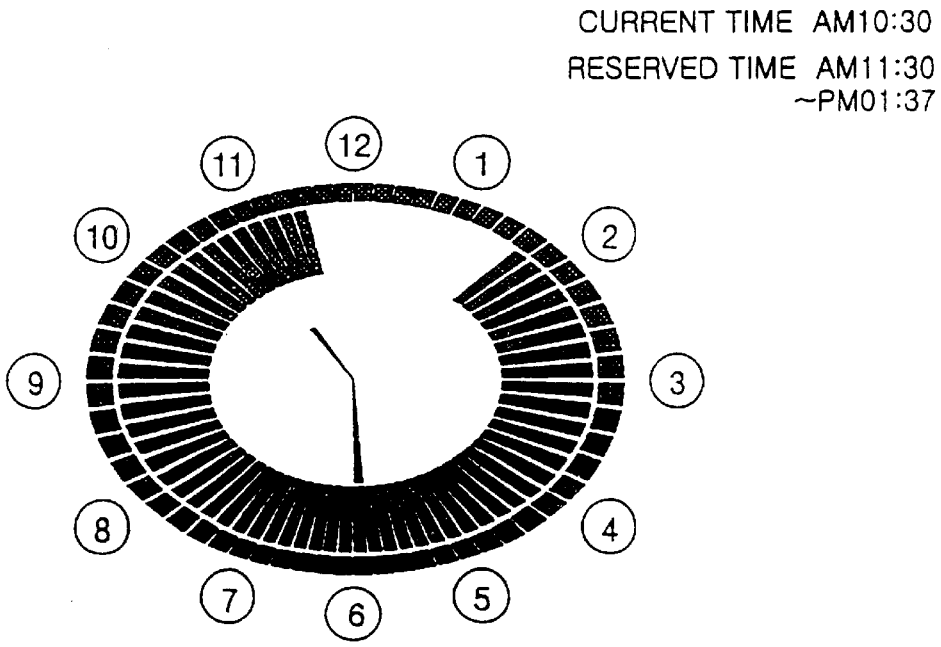

The hour unit display part 120 is uncolored from the position of 11:30 (the middle portion between the 11th button 11 and the 12th button 12) to the position of 1:37 (the middle portion between the 1st button 1 and the 2nd button 2), and the remaining portion of the hour unit display part 120 is colored with black (see FIG. 8(A)). In other words, a portion of the hour unit display part 120, which corresponds to the reserved time interval is uncolored. Then, as the current time passes 11:30, the uncolored segments of the uncolored portion on the hour unit display part 120 are converted into the colored state one by one in accordance with the current time (see FIG. 8(C)).

Figure 8B:
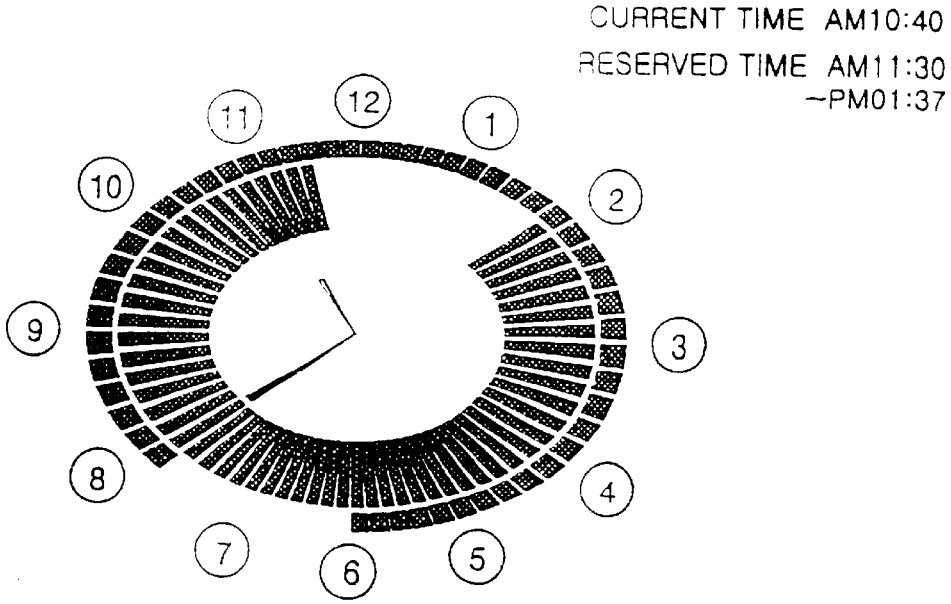
Figure 8C:
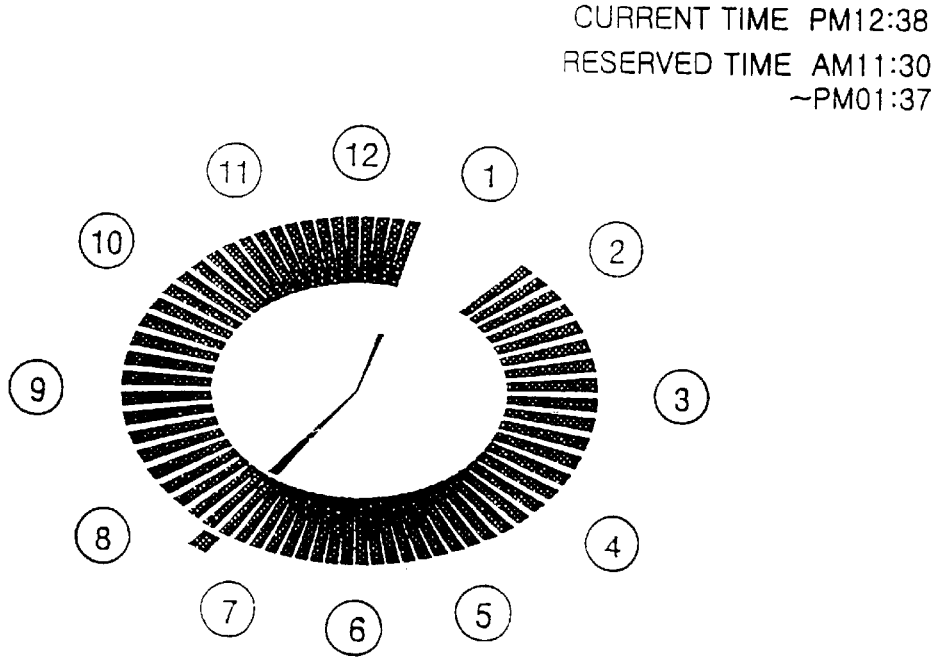

The minute unit display part 110 is processed in the same way as the C mode but the coloring conditions thereof are opposite to the C mode (see FIG. 8(B) and 8(C)).

8. The Second Example of Embodiment for Mode D

If the current time of the timer is 10:30 AM as described above, and if the reserved time interval is a predetermined period of time (for example, instant, 1 second or 1 minute, etc.) from 11:30 AM, the timer can maintain the off-state for such reserved time interval and after such interval, it can automatically go back to the on-state. In this case, the operation principle is same as in mode C and only the coloring is in reverse (Figure omitted).

9. Multiple Setting of C Mode

If situations of the C mode or D mode are repeated, namely when a number of reservations are made on the timer with predetermined time spans among them, the number of reservations can be set by repeatedly setting the C mode or D mode, and also a displayed minute unit represents a reserved time within 60 minutes from the current time as in the C mode or D mode.

For example, if the current time is 10:25 AM, a first reserved time interval is from 11:30 AM to 1:37 PM, a second reserved time interval is from 1:50 PM to 2:30 PM and a third reserved time interval is from 11:00 PM to 1:00 AM, the result displayed on the display 100 in this case is as shown in FIG. 9.

First, the hour unit display part 120 can be colored only when the reserved time is within 12 hours from the current time, and cannot be colored when the reserved time is not within 12 hours from the current time. This is because only 12 hours can be displayed by using the display 100 over 360°. Of course, the hour unit display part 120 can display a reserved time or time interval within 12 hours from the current time in the clockwise direction or in the counterclockwise direction.

Figure 9A:
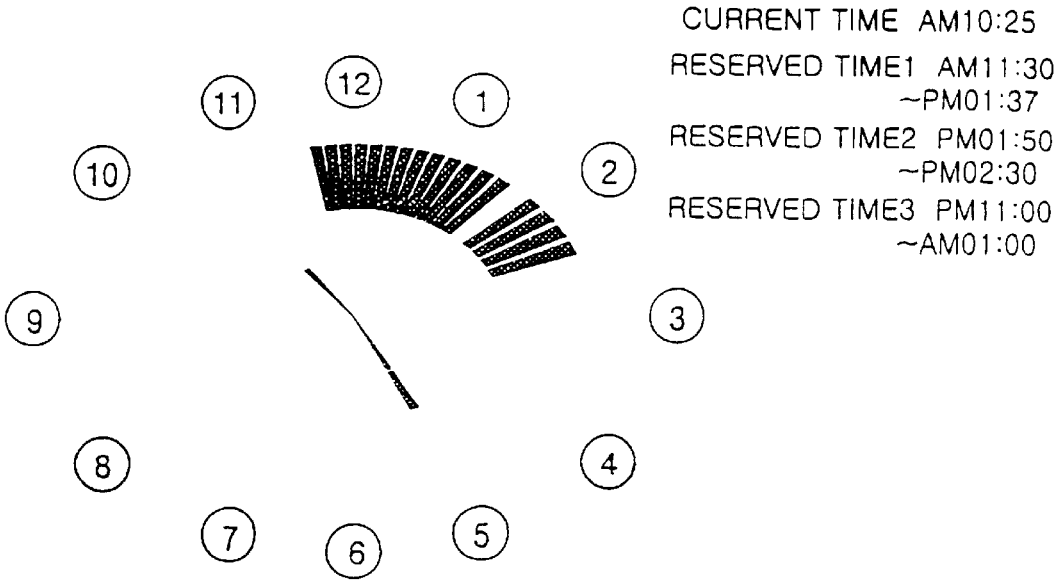
Figure 9B:
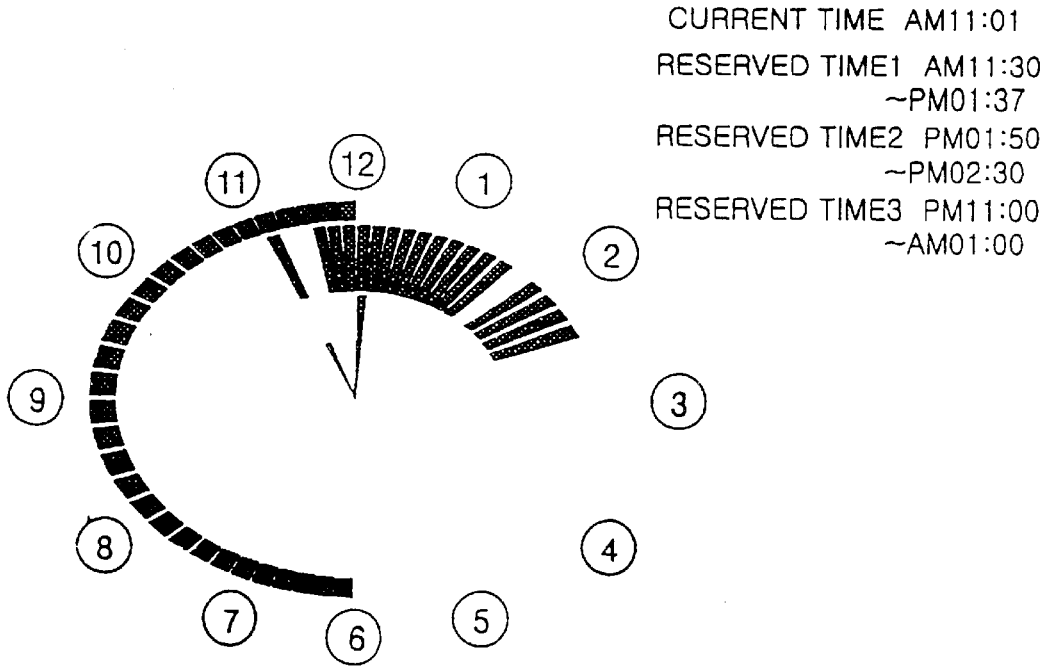

Accordingly, as shown in FIG. 9(A), since the current time is 10:25 AM, only the first reserved time interval and the second reserved time interval are displayed on the display 100. Then, as the current time pass 11:01 AM, the third reserved time interval begins to be displayed in accordance with the current time, and as the current time passes 1:00 PM, the third reserved time interval as a whole is displayed on the display 100. (FIG. 9(B))

On the other hand, if the reserved times are displayed by dividing segments in the hour unit display part, it may be difficult to recognize such reserved times by looking at the display parts, particularly in the case of multiple setting as described above. Therefore, the hour unit display part may be colored by using a unit of 5 minutes or 10 minutes. For example, if there are 2 or more time reservations within 5 or 10 minutes, the corresponding segments in the minute unit display part will be uncolored as the current time passes (for example, the segment for minute 1, the segment for minute 3, and the segment for minute 5 may be colored but the segments for minute 2 and for minute 4 may be uncolored). However, the segments in the hour unit display part will become uncolored only when all the reserved times in a certain predetermined period of time have gone by.

The minute unit display part 120 represents the reserved time or time interval which is within 60 minutes from the current time. (By using the minute unit display part 110 over 360°, it is possible to display the reserved time or time interval within 60 minutes from the current time in the clockwise direction or in the counterclockwise direction).

For example, when the current time is 10:25 AM, the minute unit display part 110 is maintained in the uncolored state. Then, as the current time reaches 10:31, the segment representing 30 minutes begins to be colored, and as the current time reaches 10:32, the segment representing 31 minutes begins to be colored. In this way, as the current time reaches 11:30, all segments of the minute unit display part 110 are colored. Also, as the current time reaches 12:38, the segment representing 38 minutes begins to be uncolored, and as the current time reaches 12:39, the segment representing 39 minutes begins to be uncolored. Further, as the current time reaches 1:37 PM, the segment representing 37 minutes is maintained in the colored state, and as the current time passes 1:37 PM, the segment representing 37 minutes is uncolored.

Figure 9C:
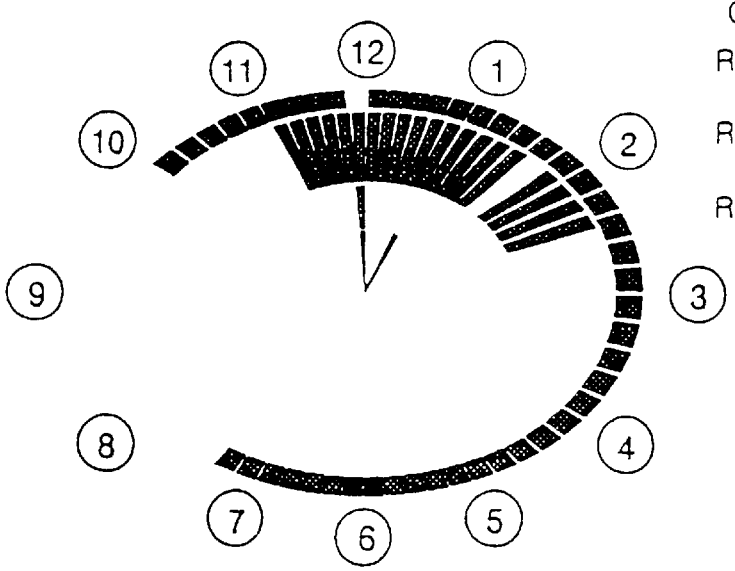

At the same time, in order to display the second reserved time interval, as the current time reaches 12:51 PM, the minute unit display part 110 begins to be colored one segment by one segment every one minute from the segment representing 50 minutes, and as the current time reaches 1:00 AM, the minute unit display part 110 is displayed as shown in FIG. 9(C).

10. Another example of embodiment of the present invention

In an another embodiment example of the present invention, the hour unit display part and the minute unit display part of the above embodiment examples of 1 through 9 are not colored in accordance with the current time. Instead, the hour unit display part shows reservations for times between 00:00 AM and 00:00 PM (noon) if the current time is AM, and if the current time is PM, it shows reservations for times between 00:00 PM and 00:00 AM (24:00). Because the minute unit display part 110 can only display the reservation state for a 60 minute period, the minute portions within the hour of the current time which correspond to any reserved time are colored or uncolored in the minute unit display part.

Figure 10A:
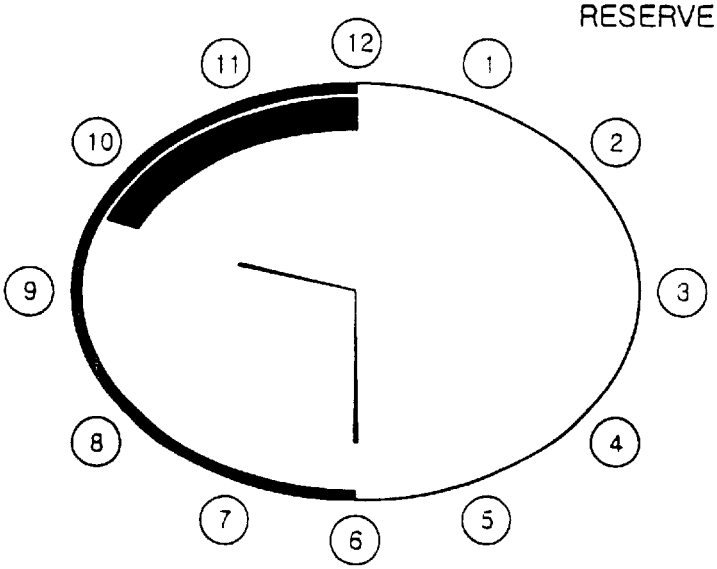
FIG. 10 is a front view illustrating another embodiment example of the present invention; and, FIG. 11 is a block diagram of the programmable time switch of the present invention.
Figure 10B:
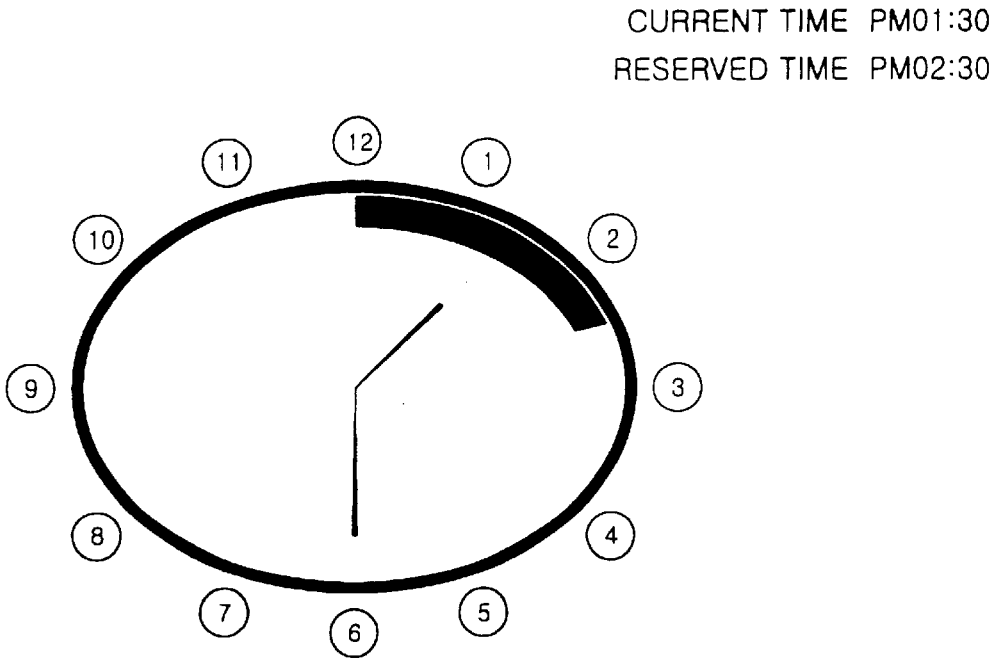

For example, if the current time is 9:30 AM and if the reserved time in the above mode A is 2:30 PM, the portions from 9:30 AM to 00:00 PM of the hour unit display part get colored. In the minute unit display part, portions from the 6th button 6 where the minute 30, which is the minute reserved within the hour of the current time, to the 12th button are colored (see FIG. 10*a*). If the time becomes 1:30 PM, the hour unit display part will be colored for portions from 00:00 PM to 2:30 PM, and all segments in the minute unit display part will be colored because all 60 minutes from 1 o'clock to 2 o'clock PM are reserved (see FIG. 10*b*).

Figure 10C:
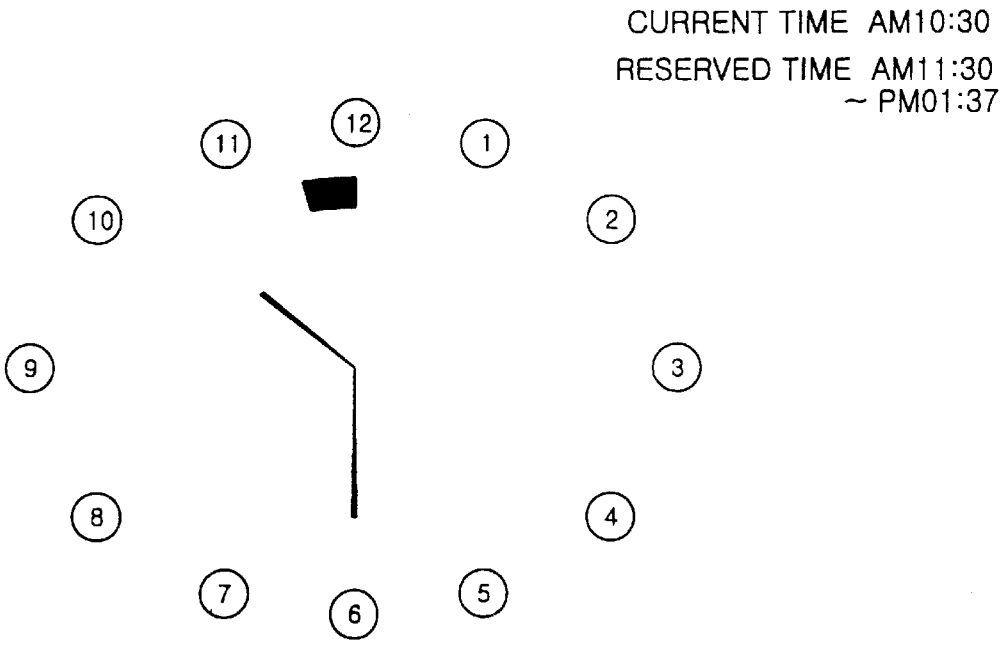
Figure 10D:
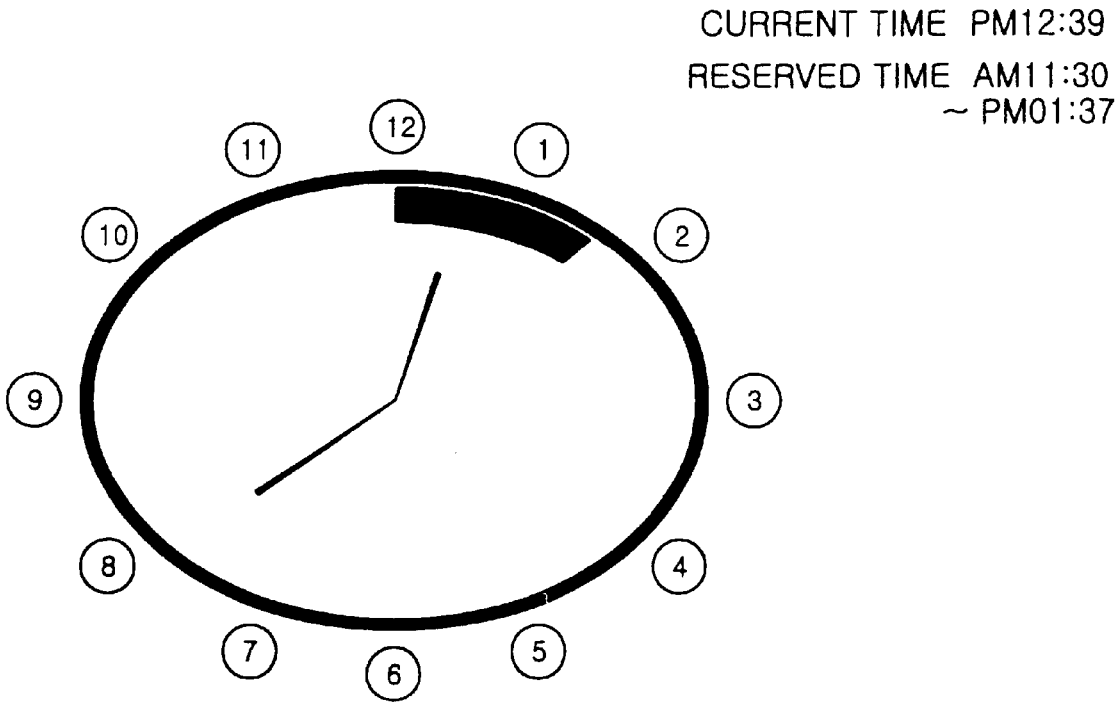

If the current time is 10:30 AM and if the reserved time in mode C is from 11:30 AM to 1:37 PM, the segments for 11:30 AM to 00:00 PM of the hour unit display part will be colored and the minute unit display part will not be colored because there is no reserved portion of minutes between 10 AM to which the current time belongs to and 11 AM (see FIG. 10*c*. Also, if the current time is 12:39 PM and if the reserved time in mode C is from 11:30 AM to 1:37 PM, the segments of the hour unit display part for 00:00 PM to 1:37 PM will be colored and the entire 60 minutes of the minute unit display part will be colored (see FIG. 10*d*).

In the above embodiment example, the timer may be set so that the coloring for the reserved time, instead of changing in accordance with the current time, would stay without change for a certain period of time.

On the other hand, since the C mode or D mode is repeated with a cycle of 24 hours, once the reserved time or time interval is made by the user, it is repeated with the cycle of 24 hours unless it is otherwise canceled by the user. A display result on the display 100 is also repeated. The cycle of repetition can be set to a week or a month, and for doing this, the set section 220 can further includes a cycle set section or which can also be included in the modes(not shown). Also, the set section 220 can further includes a cycle display section (not shown) for displaying the cycle set through the cycle set section.

In order to make reservations for a specific date or day (for example, Aug. 25, 2001 or the 300th day of the year 2000, etc.), buttons for date or day may be included in the set section or the mode display part may additionally have a day selection mode. Also, in order to confirm the date or the day set thereby, a separate date (day) display part (not represented in the figures) must be constructed additionally. The timer can of course be set for a specific time or for a specific period of time on the date or day set as described above.

Future, an operation for canceling the reserved time or time interval can be performed as follows.

Namely, if the current time belongs to PM and it is required to cancel the reserved time interval from 1:35 PM to 3:20 PM, the cancel button C is pressed, and a button of a number which corresponds to the time unit between 1:35 PM and 3:20 PM, namely the 2nd button 2 or the 3rd button 3 is pressed. By doing this, the reserved time or time interval which is overlapped with the time unit which corresponds to the pressed 2nd button 2 or 3rd button 3 is automatically canceled.

Also, if the current time belongs to the PM and it is required to cancel the reserved time interval from 1:36 AM to 1:37 AM, the cancel button C is also first pressed, and then the AM/PM button AP is pressed. Thereafter, the 1st button 1 is pressed and the 7th button 7 denoting 35 minutes is pressed two times, to cancel the reserved time interval.

Furthermore, all reservations for times that belong to a specific hour may be cancelled by pressing the cancel button C and the number corresponding to such specific hour. Namely, in mode C, if the current time is AM and if there are 2 reservations for 9:10 PM and for 9:40 PM or 2 reservations for a time interval of 9:10 PM through 9:20 PM and for another interval of 9:40 PM through 9:50 PM, first the cancel button C is pressed, then the AM/PM select button AP is pressed to select PM, and then the 9th button 9 is pressed. Then, all reservations between 9 PM and 10 PM are cancelled and the display 100 changes accordingly.

Also, after the cancel button C is pressed, within a predetermined period of time (for example, 5 seconds), by pressing the number buttons corresponding the hours to which times reserved belong (1 through 12), multiple reservations may continuously be cancelled.

Here, when the cancel button C is pressed again, the timer will recognize the completion of cancellation process and will return to the original screen. Also, if a predetermined period of time (for example, 10 seconds or 20 seconds) passes without any button pressed, then the timer will return to the original screen in accordance with the current time.

On the other hand, in order to confirm reservations, the following operation is conducted. To confirm the reservation in AM or in PM at a glance through the hour unit display part, the AM/PM select button AP is pressed. If the current time is AM, the hour unit display part 120 will show the reservations made for times from 00:00 AM through noon (12).

In other words, if it is required to confirm reservations of the AM or the PM through the hour unit display part 120 at a glance, by pressing the AM/PM button AP, when the current time belongs to the AM, the reserved time or time interval set from 00:00 AM to 12:00 AM is displayed on the hour unit display part 120. Then, by pressing the AM/PM button AP one time, the reserved time or time interval set from 12:00 PM to 24:00 PM is displayed. In this state, by pressing the AM/PM button AP one more time, the screen displays again reservations belonging to the AM. If the current time belongs to the PM, by pressing the AM/PM button AP, reservations (from 12:00 PM to 24:00 PM) belonging to the PM are displayed, and by pressing the AM/PM button AP, reservations (from 00:00 AM to 12:00 AM) are displayed.

Also, in order to confirm reservations through the minute unit, a user may select a screen to be confirmed (AM or PM screen) by pressing the AM/PM select button AP and press a number for an hour to which the reserved time belongs. If there is any reservation in that hour, the minute unit reservation is displayed in the display 100. If there is no reservations, the display 100 will show reservation and thus the reservations may be conveniently confirmed.

For example, if the current time belongs to the AM and the reserved time interval is from 9:15 AM to 9:21 AM, after the AM/PM button AP is pressed, the 9th button 9 is pressed. By this, reservations belonging to the AM are displayed as a whole on the hour unit display part 120 and the minute unit display part 110. For example, segments of the minute unit display part 110 are colored from a position of the 3rd button 3 denoting 15 minutes to a position of a segment clockwise next to a 4th button 4 denoting 20 minutes, and also, if a user presses buttons for different hours continuously within a predetermined period of time (for example, 9 seconds), the reservations for minutes which belong to the corresponding hours will be continuously displayed. If a predetermined period of time (for example, 9 seconds) passes without any input or if the cancel button C is pressed, the original screen will be displayed in accordance with the current time.

For the purpose of confirming reservations as described above, a separate confirmation button may be installed and used instead of the AM/PM select button AP. In this case, the hour unit display part for reservation may automatically display reservations for the time period 12 hours around the current time. The minute unit display part, which is colored for reserved time, may display reservations set for 60 minutes around the current time.

When the reserved time is reached after the timer is set, contacts of the timer are moved to a predetermined mode. At this time, the hour unit display part 120 and the minute unit display part 110 can be flashed to allow the user to confirm the fact that the contacts of the timer are moved to the predetermined mode. In this way, the operation of the timer can be checked.

INDUSTRIAL APPLICABILITY

As a result, by a programmable time switch of the present invention, advantages are provided in that a number of time reservations are easily set and simply confirmed, whereby convenience of a user is enhanced.

In the drawings and specification, there have been disclosed typical preferred embodiments of the invention and, although specific terms are employed, they are used in a generic and descriptive sense only and not for purposes for limitation, the scope of the invention being set forth in the following claims.

The time reservation equipment and the time reservation method using such equipment of the present invention may be used as a timer which controls operations of various household electrical appliances, electronic and electrical machinery and tools. For example all or part of the present invention including the reservation display part or methods for setting reservations may be installed in a monitor for a personal computer or for a television, in an automatic teller machine located at the entrance of a bank or a building, or in a monitor of the computer showing information about businesses in a building.

What is claimed is:

1. A programmable time switch comprising:

a display for displaying a time or time interval set by a user to be reserved, the display having a current time display part formed at a center portion thereof for displaying an hour hand and a minute hand which represent a current time, an hour unit display part formed at a middle portion thereof for displaying the reserved time or time interval in terms of hours, and a minute unit display part formed at an edge portion thereof for displaying the reserved time or time interval in terms of minutes;

a current time display section and an AM/PM display section for digitally displaying the current time and the AM or PM, respectively;

a set section having a plurality of buttons for setting, canceling or confirming the reserved time or time interval;

a control section for controlling through a drive section a peripheral interface connected thereto in accordance with the reserved time or time interval set through the set section, and for displaying the reserved time or time interval through the display;

a memory for providing a program and a work area which are necessary for controlling operation of the control section; and a clock supply section for supplying a clock which is necessary for the controlling operation of the control section.

2. The programmable time switch as claimed in claim 1, wherein the set section comprises:

twelve time set buttons disposed around the display for symbolizing one through twelve o'clock, the twelve time set buttons allowing the reserved time or time interval to be set through it;

a current time set button used when setting the current time;

a timer set button used when setting the reserved time or time interval as a timer;

a cancel button for canceling the reserved time or time interval;

an AM/PM select button for selecting the AM or PM and for confirming the reserved time or time interval of the timer.

3. The programmable time switch as claimed in claim 1, wherein the reserved time or time interval is set through the set section such that the programmable time switch is turned on or off between the current time and the reserved time or after the reserved time interval is lapsed from the current time; and when the timer is converted from an on-state to an off-state or from the off-state to the on-state, the display is colored between a position of the current time and a position of the reserved time in the clockwise direction or in the counterclockwise direction.

4. The programmable time switch as claimed in claim 1, wherein when the timer is started form the off-state, it is converted to the on-state for a predetermined time and returned to the off-state or when these situations are repeated several times, or when the timer is started from the on-state, it is converted to the off-state for a predetermined time and returned to the on-state or when these situations are repeated several times, the display is colored over the reserved time interval in the on-state or uncolored over the reserved time interval in the off-state.

5. The programmable time switch as claimed in claim 1, wherein when setting the reserved time or time interval using the twelve time set buttons, an o'clock is inputted by a button first pressed, and a minute is inputted by another button pressed second at least one time.

6. The programmable time switch as claimed in claim 1, wherein the hour unit display part is used for displaying in terms of hours the reserved time or time interval which is within 12 hours form the current time in the clockwise direction or in the counterclockwise direction, and is automatically colored or uncolored in accordance with the current time; and the minute unit display part is used for displaying in terms of minutes the reserved time or time interval which is within 60 minutes from the current time in the clockwise direction or in the counterclockwise direction, and is automatically colored or uncolored in accordance with the current time.

7. The programmable time switch as claimed in claim 1, wherein once the reserved time or time interval is set by the user, it is repeated with a cycle of 24 hours unless otherwise canceled.

8. The programmable time switch as claimed in claim 1, wherein once the reserved time or time interval is set by the user, it is repeated with a cycle of predetermined days unless otherwise canceled.

9. The programmable time switch as claimed in claim 1, further comprising:

a mode display section for displaying an operating mode of the timer;

a switch for keeping the drive section turned on or off irrespective of setting for the timer or for making the drive section operate the timer; and a mode select button for selecting the operating mode of the timer.

10. The programmable time switch as claimed in claim 1, further comprising:

a date or day select button which enables the user to set a specific date for the timer; and a display part for the said specific date for setting the timer.

11. The programmable time switch as claimed in claim 1, further comprising:

a date or day select mode which enables the user to set a specific date for the timer; and a display part for the said specific date setting the timer.

12. The programmable time switch as claimed in claim 1, wherein the hour unit display part is used for automatically displaying the reserved time or time interval in AM or in PM and is colored or uncolored in accordance with the current time; and the minute unit display part is used for displaying the reserved time or time interval which is within the hour unit of the current time and is colored or uncolored in accordance with the current time.

13. The programmable time switch as claimed in claim 1, wherein the reserved time or time interval is not colored or uncolored in accordance with the current time but is maintained for a predetermined period of time.

14. The programmable time switch as claimed in claim 1, wherein the input method for said set section may be by button or by screen touch.

15. A method of using the programmable time switch of claim 1 comprising:

a step to set the current time;

a step to store the said current time in the memory device;

a step to select a mode for setting the timer to reserve a time or a time interval based upon the said current time;

a step to set the reserved time or time interval in the said selected mode;

a step to store the reserved time or time interval in the memory device; and a step to confirm, modify or cancel the said current time and the said reserved time or time interval.

* * * * *